US009631161B2

(12) United States Patent
Sungail et al.

(10) Patent No.: US 9,631,161 B2
(45) **Date of Patent: *Apr. 25, 2017**

(54) METHOD OF SEPARATING OIL FROM A LIQUID STILLAGE

(71) Applicant: CRODA, INC., Edison, NJ (US)

(72) Inventors: Craig Michael Sungail, Chadds Ford, PA (US); Min Ma Wang, Kenneth Square, PA (US); Xin Chen, Hockessin, DE (US); Ronald Eugene Bingeman, Brookhaven, PA (US)

(73) Assignee: CRODA, INC., Edison, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/145,085

(22) Filed: May 3, 2016

(65) Prior Publication Data

US 2016/0244694 A1 Aug. 25, 2016

Related U.S. Application Data

(63) Continuation of application No. 14/905,092, filed as application No. PCT/US2014/045711 on Jul. 8, 2014.

(60) Provisional application No. 61/847,727, filed on Jul. 18, 2013.

(51) Int. Cl.

| | |
|---|---|
| ***C11B 13/00*** | (2006.01) |
| ***C11B 1/10*** | (2006.01) |
| ***C11B 3/16*** | (2006.01) |

(52) U.S. Cl.

CPC ..... *C11B 13/00* (2013.01); *C11B 1/10* (2013.01); *C11B 3/16* (2013.01)

(58) Field of Classification Search

None

See application file for complete search history.

(56) References Cited

U.S. PATENT DOCUMENTS

| | | | | |
|---|---|---|---|---|
| 6,268,010 | B1 * | 7/2001 | Sekula | A23D 7/011 426/601 |
| 6,310,106 | B1 * | 10/2001 | Podubrin | C08G 65/2615 208/188 |
| 6,566,305 | B1 * | 5/2003 | Milius | A01N 25/02 504/116.1 |
| 7,026,363 | B2 * | 4/2006 | Leinweber | C10G 33/04 210/708 |
| 7,497,955 | B2 | 3/2009 | Scheimann | |
| 7,566,469 | B2 | 7/2009 | Scheimann | |
| 8,008,517 | B2 | 8/2011 | Cantrell | |
| 8,168,037 | B2 | 5/2012 | Winsness | |
| 8,841,469 | B2 | 9/2014 | Shepperd | |
| 8,962,059 | B1 * | 2/2015 | Froderman | C11B 3/16 426/601 |
| 9,090,851 | B2 | 7/2015 | Blankenburg | |
| 2012/0125859 | A1 | 5/2012 | Collins | |
| 2014/0171670 | A1 | 6/2014 | Jenkins | |

FOREIGN PATENT DOCUMENTS

| | | |
|---|---|---|
| WO | 2012128858 | 9/2012 |
| WO | 2014099078 | 6/2014 |

OTHER PUBLICATIONS

Fleck, E.W., Industrial surfactants, Second Edition, 1993, Noyes Publications, 4 pages.*

International Preliminary Report on Patentability and Written Opinion for International Application No. PCT/US2014/045711 issued Jan. 19, 2016.

International Search for International Application No. PCT/US2014/045711 mailed Oct. 24, 2014.

Non-Final Office Action dated Sep. 9, 2016 for U.S. Appl. No. 14/905,092, 18 pages.

Non Final Office Action for U.S. Appl. No. 15/030,210, mailed Nov. 3, 2016, 13 pages.

* cited by examiner

*Primary Examiner* — Yate K Cutliff

(74) *Attorney, Agent, or Firm* — Ratnerprestia

(57) ABSTRACT

A method of separating oil from a liquid stillage is disclosed. The stillage includes an aqueous phase and an oil phase. The method comprises adding a separation additive to the stillage and performing at least one separation operation on the stillage to separate an amount of the oil phase from the stillage. The separation additive comprises an ester of an alkoxylated non-cyclic polyol and a fatty acid.

20 Claims, No Drawings

METHOD OF SEPARATING OIL FROM A LIQUID STILLAGE

This application is a continuation application of U.S. application Ser. No. 14/905,092, filed on Jan. 14, 2016, which is a U.S. National Phase application of PCT International Application No. PCT/US2014/0 45711, filed Jul. 8, 2014, which is related to, and claims the benefit of priority of, U.S. Provisional Application No. 61/847,727, entitled A METHOD OF SEPARATING OIL FROM A LIQUID STILLAGE, filed on 18 Jul. 2013, the contents of all the application are incorporated herein by reference in their entirety for all purposes.

The present invention relates to a method of separating oil from a liquid stillage. The invention also relates to the use of a separation additive to treat the stillage and to a mixture of the separation additive and the stillage. The invention may assist in improving the recovery of corn oil from the stillage produced during the manufacture of ethanol from corn.

There is growing interest in the use of ethanol to supplement fossil fuels as an energy source in transport. For example, ethanol accounted for 9% of gasoline consumption in the United States of America in 2009, and 90% of the ethanol produced in the US in 2009 was produced with corn as feedstock. The majority of existing corn ethanol mills, and almost exclusively all the corn ethanol mills commissioned in the recent years, are so called "dry mills."

A "dry mill" plant processes corn into ethanol through a dry grinding process. The ground corn is mixed with water to form mash, and then an enzyme is added to convert corn starch into sugar. A fermentation process is followed to convert the sugar into ethanol. The liquid intermediate, called "beer," is further processed by distillation and ethanol is collected. The leftover in the "beer" after the removal of ethanol is called stillage, which contains water, protein, nutrients, fibre, and corn oil. The stillage includes an aqueous phase and an oil phase. The corn oil may be separated from the stillage through a centrifuge and collected as a higher value co-product. A separation additive may be added into the stillage to enhance the separation of the oil phase from the water phase and increase the corn oil yield.

Ethanol plants may treat whole stillage from the "beer" column via centrifugation to produce wet cake and thin stillage, then further treat the thin stillage stream by subjecting it to multiple effect evaporation to increase the solids content and recover the distillate for return use in the process. As the solids content increases, the thin stillage is typically referred to as syrup. The syrup is typically combined with wet cake or distillers' dry grains (DDG) and sold as animal feed.

The corn oil yield from a stillage depends on many factors, such as corn kernel quality, water content, the particle size of the solids in the stillage, the process temperature of the stillage in the centrifuge, and the design of the separation equipment. The use of a corn oil separation additive is intended to increase the corn oil yield.

WO2012/128858 of Hercules Incorporated discloses the use of polyoxyethylene(20) sorbitan mono-laurate (polysorbate 20), polyoxyethylene(20)sorbitan mono-stearate (polysorbate 60) and polyoxyethylene(20)sorbitan mono-oleate (polysorbate 80) as corn oil separation additives. The specific additives disclosed in WO2012/128858 are all based on sorbitan which is a cyclic compound produced by the dehydration of the sugar alcohol sorbitol.

Though the yield of corn oil obtained from stillage in the presence of such sorbitan based additives is improved over the yield in a process without the use of any additives, there is still a significant amount of corn oil left un-collected, and discharged unseparated from the stillage as part of a product with lower commercial value.

The present invention seeks to improve the recovery of oil from an aqueous liquid stillage.

The present invention is based in part on the recognition that a multi-esterified fatty acid ester of an alkoxylated non-cyclic polyol may perform better as a corn oil separation additive than a mono-ester of an alkoxylated sorbitan, such as a polysorbate.

Thus viewed from one aspect, the present invention provides a method of separating oil from a liquid stillage, the stillage including an aqueous phase and an oil phase, wherein the method comprises adding a separation additive to the stillage and performing at least one separation operation on the stillage to separate an amount of the oil phase from the stillage, wherein the separation additive comprises an ester of an alkoxylated non-cyclic polyol residue and a fatty acid and wherein the degree of esterification of the ester is at least two.

Without wishing to be bound by theory, it is believed that the multiple fatty acid tails present in the separation additive due to the degree of esterification of the separation additive being at least two provide a multi-tailed (for example, comb-like or spider-like) structure to the separation additive. This multi-tailed structure combined with the structural flexibility of the non-cyclic polyol when compared with a cyclic polyol (e.g. sorbitan) may encourage a multi-point interaction between the separation additive and triglycerides which may be present in the oil phase of the stillage. The multi-point interaction reduces the interfacial tension between the oil phase and water phase more than a monoester such as a polysorbate. When the interfacial tension is reduced more, the mobility of the oil drops in water is increased, so the time taken for oil drops to coalescence and separate from the aqueous phase is reduced. The result is a higher oil yield in a shorter period of time.

As a comparison, the performance of alkoxylated sorbitans which have been multiply esterified (i.e. having a degree of esterification higher than one) were tested and the test results are presented in the Examples provided herein. It appears that multiple or full esterification of alkoxylated sorbitans reduces their performance in separating corn oil instead of improving it. Therefore it appears that there is a synergy in the present invention between the degree of esterification of at least two and the choice of a non-cyclic polyol residue as the core group of the separation additive which is not present in the dehydrated sorbitan esters of the prior art.

The method of the present invention may increase the amount of the oil phase separated from the stillage when compared with a separation method in which no separation additive is used. The method of the present invention may increase the amount of the oil phase separated from the stillage when compared with a separation method in which an equivalent amount of polysorbate 80 is used. The separation of an increased amount of the oil phase from the stillage may improve the corn oil yield of the process. The separation of an increased amount of the oil phase from the stillage may also reduce the amount of oily deposits on stillage process equipment downstream of the separation. This may reduce the need for cleaning of this equipment and so may reduce the amount of downtime required to maintain the equipment.

In addition, the corn oil recovered using the method of the present invention may be of improved quality. The corn oil recovered may have a lower solids content or a lower water content than corn oil recovered without using the separation additive of the present invention.

As used herein, the terms 'for example,' 'for instance,' 'such as,' or 'including' are meant to introduce examples that further clarify more general subject matter. Unless otherwise specified, these examples are provided only as an aid for understanding the applications illustrated in the present disclosure, and are not meant to be limiting in any fashion.

It will be understood that, when describing the number of carbon atoms in a substituent group (e.g. 'C1 to C6 alkyl'), the number refers to the total number of carbon atoms present in the substituent group, including any present in any branched groups. Additionally, when describing the number of carbon atoms in, for example fatty acids, this refers to the total number of carbon atoms including the one at the carboxylic acid, and any present in any branch groups.

It will be understood that any upper or lower quantity or range limit used herein may be independently combined.

Many of the chemicals which may be used to produce the separation additive used in the present invention are obtained from natural sources. Such chemicals typically include a mixture of chemical species due to their natural origin. Due to the presence of such mixtures, various parameters defined herein can be an average value and may be non-integral.

The term 'non-cyclic' as used herein refers to a molecule or part of a molecule which does not include a ring or cyclic structure.

The term 'polyol' is well known in the art, and refers to an alcohol comprising more than one hydroxyl group. The term 'active hydrogen' refers to the hydrogen atoms present as part of the hydroxyl groups of the polyol.

The term 'polyol residue' as used herein, unless otherwise defined, refers to an organic radical derived from a polyol by removal of one or more active hydrogen atoms, each active hydrogen atom being from one of the hydroxyl groups present.

The non-cyclic polyol may be a C3 to C8 polyol, preferably a C3 to C7 polyol, more preferably a C3 to C6 polyol. Preferably, the non-cyclic polyol is selected from the group consisting of glycerol, neopentyl glycol, trimethylol propane, pentaerythritol, a sugar alcohol and mixtures thereof.

Since the number of hydroxyl groups present on the polyol is equivalent to the number of m active hydrogen atoms, the preferred numbers of hydroxyl groups present will be the same as listed for the preferred numbers of m active hydrogen atoms.

A core group of the separation additive may be a non-cyclic polyol residue. The non-cyclic polyol residue may be homogeneous in that it comprises only one specific polyol residue and is formed from one specific polyol as a starting material. In an alternative embodiment, the starting material may be heterogeneous in that it comprises a mixture of a number of different polyols having different values of m, and therefore the polyol residue formed therefrom may be heterogeneous. The polyol may be selected from diols, triols, tetrols, pentols, hexols, heptols, or octols. The polyol may be a triol or a hexol. Preferably the polyol is a hexol.

The non-cyclic polyol may be a linear polyol. The non-cyclic polyol may comprise a linear (i.e. not branched) carbon chain.

The non-cyclic polyol residue does not contain any ring or cyclic structures. Without wishing to be bound by theory, the absence of a ring or cyclic structure in this core group may make the separation additive molecule more flexible or less bulky and therefore better able to interact with the triglycerides present in the oil phase of the stillage. This may improve the separation performance of the separation additive.

In one particular embodiment, polyols obtainable from natural sources may be preferred. In particular, sugar alcohols may be used to form the polyol residue. Preferably the non-cyclic polyol is a non-cyclic sugar alcohol. The sugar alcohol may have the molecular formula $C_aH_{2a+2}O_a$. The value a may be from 3 to 6, corresponding to a sugar alcohol with 3 to 6 carbon atoms. The sugar alcohol may have an equal number of carbon atoms and oxygen atoms. The sugar alcohol which may be reacted to form the non-cyclic polyol residue is not a dehydrated or anhydrous sugar alcohol such as a sorbitan The sugar alcohol may be a hydrated sugar alcohol i.e. it is not dehydrated.

The sugar alcohol may comprise one or more of glycerol (3-carbon), erythritol (4-carbon), threitol (4-carbon), arabitol (5-carbon), xylitol (5-carbon), ribitol (5-carbon), mannitol (6-carbon), sorbitol (6-carbon), galactitol (6-carbon), fucitol (6-carbon), and iditol (6-carbon).

The sugar alcohol may be selected from the group consisting of glycerol, erythritol, threitol, arabitol, xylitol, ribitol, mannitol, sorbitol, galactitol, fucitol and iditol.

The sugar alcohol may comprise a $C_3$ to $C_6$ sugar alcohol.

Preferably, the non-cyclic polyol residue is formed from glycerol, sorbitol or mixtures thereof. Preferably, the non-cyclic polyol residue is formed from sorbitol.

Preferably the sugar alcohol includes glycerol or sorbitol. The sugar alcohol may be glycerol or sorbitol. Preferably the sugar alcohol is sorbitol.

A pure sugar alcohol such as 100% sorbitol may be a solid at room temperature which may be difficult to alkoxylate. Therefore the reactant composition used to make the separation additive may include the sugar alcohol and an amount of water. The reactant composition may include up to 30 wt % water, preferably up to 20 wt % water, more preferably up to 10 wt % water.

The separation additive may comprise a compound of the formula (I):

$$R^1.[(AO)_n.R^2]_m \quad (I)$$

where:

$R^1$ is the core group which is the residue of a non-cyclic polyol having at least m active hydrogen atoms;

AO is an alkylene oxide group;

each n is independently from 1 to 20, with the total of all n values being at least 25, preferably at least 30;

m is at least 2, preferably at least 3; and each $R^2$ is independently H, or an acyl group —OC.$R^3$ where $R^3$ is a $C_5$ to $C_{23}$ hydrocarbyl group.

The index m is a measure of the functionality of the $R^1$ core group. Generally the alkoxylation reactions will replace all active hydrogen atoms in the molecule from which the core group is derived. However, reaction at a particular site may be restricted or prevented by steric hindrance or suitable protection. The terminating hydroxyl groups of the polyalkylene oxide chains in the resulting compounds are then available for reaction with acyl compounds to form ester linkages.

The index m is at least 2, preferably at least 3, more preferably at least 4, yet more preferably at least 5. The index m may be up to 8, preferably up to 7. Preferably the index m has a value from 5 to 7. The index m may be about 6.

Mixtures may be employed, and therefore the index m can be an average value and may be non-integral.

A fully esterified compound will have a degree of esterification equivalent to the index m.

The compound of the formula (I) may be the ester of an alkoxylated non-cyclic polyol and a fatty acid.

The degree of esterification of the ester of an alkoxylated non-cyclic polyol and a fatty acid is at least 2. The degree of esterification may be at least 2.5, preferably at least 3, more preferably at least 3.5. The degree of esterification may be up to 6.5, preferably up to 5.5, more preferably up to 4.5. Preferably the degree of esterification is in the range from 2.5 to 5.5. The degree of esterification may be in the range from 3.5 to 4.5. As shown in Example 3 below, a degree of esterification of about 4 may provide improved separation performance. The ester of an alkoxylated non-cyclic polyol residue and a fatty acid may be a partial ester.

Mixtures may be employed, and therefore the degree of esterification can be an average value and may be non-integral.

The alkylene oxide groups AO are typically groups of the formula: —($C_rH_{2r}O$)— where r is 2, 3 or 4, preferably 2 or 3, i.e. an ethyleneoxy (—$C_2H_4O$—) or propyleneoxy (—$C_3H_6O$—) group. AO may represent different groups along the alkylene oxide chain. Generally, it is desirable that the chain is a homopolymeric ethylene oxide chain. However, the chain may be a homopolymer chain of propylene oxide residues or a block or random copolymer chain containing both ethylene oxide and propylene oxide residues. Where co-polymeric chains of ethylene and propylene oxide units are used, the molar proportion of ethylene oxide units used may be at least 50 mol %, preferably at least 70 mol %, more preferably at least 80 mol %.

The number of alkylene oxide groups in the (poly) alkylene oxide chains, i.e. the value of the each parameter n, will preferably be in the range from 1 to 20, more preferably 1 to 15, and particularly preferably 1 to 10. The total of the indices n (i.e. n×m) is preferably in the range from 20 to 100, more preferably 30 to 80, particularly preferably 40 to 60. The value of the index n is an average value, which includes statistical variation in the chain length.

Preferably the alkoxylated non-cyclic polyol has been alkoxylated with at least 25 moles of an alkylene oxide, more preferably at least 30 moles, yet more preferably at least 35 moles, even more preferably at least 40 moles and especially preferably at least 45 moles of an alkylene oxide.

The alkoxylated non-cyclic polyol may be alkoxylated with at most 75 moles of an alkylene oxide, preferably at most 65 moles, more preferably at most 60 moles, even more preferably at most 55 moles of an alkylene oxide.

Where the number of acyl groups in the molecule is significantly less than m, the distribution of such groups may depend on the nature of the core group and on the extent and effect of the alkoxylation of the core group. For example, where the core group is derived from a sugar alcohol such as sorbitol, in which the active hydrogen atoms are not equivalent, alkoxylation will typically give unequal chain lengths for the polyalkyleneoxy chains. This may result in some chains being so short that the other (longer) chains exert significant steric effects making esterification at the "short chain" terminal hydroxyl groups relatively difficult. Esterification then will generally preferentially take place at the "long chain" terminal hydroxyl groups. The alkoxylation chain length may be randomly distributed.

The separation additive may be manufactured from a reactant composition which contains the non-cyclic polyol (for example, a sugar alcohol) and an amount of water. This water may be alkoxylated and then esterified during the synthesis of the separation additive. Therefore the separation additive may also include an amount of polyalkylene glycol (PAG) ester.

The polyalkylene glycol may be a polyethylene glycol, a polypropylene glycol, a mixed poly(ethylene-propylene) glycol or a mixed poly (ethylene-butylene) glycol.

Preferably the polyalkylene glycol is a polyethylene glycol.

The separation additive may further comprise an ester of a polyalkylene glycol (PAG) and a fatty acid (a PAG ester) in addition to the ester of an alkoxylated non-cyclic polyol. The polyalkylene glycol may be a homopolymer chain of ethylene oxide residues. Alternatively, the polyalkylene glycol may be a homopolymer chain of propylene oxide residues or a block or random copolymer chain containing both ethylene oxide and propylene oxide residues. Where copolymeric chains of ethylene and propylene oxide units are used, the molar proportion of ethylene oxide units used may be at least 50% preferably at least 70%, more preferably at least 80%.

The separation additive may comprise at least 70 wt % of the ester of an alkoxylated non-cyclic polyol and a fatty acid, preferably at least 80 wt %, more preferably at least 85 wt %, even more preferably at least 90 wt %. The separation additive may comprise at least 95 wt % of the ester of an alkoxylated non-cyclic polyol and a fatty acid. The separation additive may consist essentially of the ester of an alkoxylated non-cyclic polyol and a fatty acid. The separation additive may consist of the ester of an alkoxylated non-cyclic polyol and a fatty acid.

The separation additive may further comprise less than 30 wt % of a PAG ester, preferably less than 20 wt %, more preferably less than 10 wt %. The PAG ester may be a mono-ester, di-ester or a mixture thereof.

The PAG ester may be synthesised at the same time as the alkoxylated non-cyclic polyol ester. Alternatively the separation additive may be made by mixing a PAG ester and the alkoxylated non-cyclic polyol ester.

The fatty acid in the PAG ester and the fatty acid in the alkoxylated non-cyclic polyol ester may be the same or different.

The fatty acid may be saturated. The fatty acid may be unsaturated. The fatty acid may be mono-unsaturated. The fatty acid may be poly-unsaturated, for example soya fatty acid.

The fatty acid may be linear, branched or a mixture of linear and branched species. Preferably the fatty acid is linear.

The fatty acid may be a mono-carboxylic acid

The fatty acid may be a mixture of chemical species. The fatty acid may be of natural origin. Such fatty acids are typically a mixture of chemical species.

The fatty acid may have at least 6 carbon atoms, preferably at least 12 carbon atoms, more preferably at least 14 carbon atoms, even more preferably at least 16 carbon atoms. The fatty acid may have at most 24 carbon atoms, preferably at most 22 carbon atoms, more preferably at most 20 carbon atoms. Preferably the fatty acid has from 6 to 24 carbon atoms, more preferably from 14 to 22 carbon atoms, even more preferably from 16 to 20 carbon atoms.

The fatty acid may be selected from the group consisting of oleic acid, soya fatty acid, dehydrated castor oil fatty acid (DCOFA), corn oil fatty acid (COFA), hydrogenated castor oil fatty acid, tall oil fatty acid (TOFA), palm oil, caprylic acid, capric acid and mixtures thereof. Preferably the fatty acid is selected from the group consisting of oleic acid, soya fatty acid, dehydrated castor oil fatty acid (DCOFA), corn oil fatty acid (COFA) and mixtures thereof.

The fatty acid may include oleic acid. The fatty acid may include at least 50 wt % oleic acid, preferably at least 70 wt % oleic acid. The fatty acid may consist essentially of oleic acid.

Preferably the separation additive comprises an ester of an ethoxylated sorbitol and a fatty acid having from 6 to 20 carbon atoms wherein the sorbitol has been ethoxylated with from 45 to 55 mols of ethylene oxide and the degree of esterification is from 3.5 to 4.5.

The separation additive may be made by firstly alkoxylating $R_1$ core groups containing m active hydrogen atoms, by techniques well known in the art, for example by reacting with the required amounts of alkylene oxide, for example ethylene oxide and/or propylene oxide.

The second stage of the process may comprise reacting the alkoxylated non-cyclic polyol residue with a fatty acid or a derivative thereof. The direct reaction between the fatty acid and the alkoxylated precursor can be carried out, with or without catalysts, by heating preferably to a temperature of greater than 100° C., more preferably in the range from 200 to 250° C. Synthesis using reactive derivatives will usually be possible under milder conditions, for example using lower fatty acid esters, fatty acid chlorides and/or their respective anhydrides. Purification of the reaction product does not usually appear to be necessary, but can be carried out if desired.

The alkylene oxide groups of the separation additive may be generally hydrophilic. The fatty acid residues may be generally hydrophobic (lipophilic). The balance between the hydrophilic parts of the separation additive and the lipophilic parts may be characterised by the hydrophilic-lipophilic balance (HLB) value. The HLB value can be calculated using Griffin's method as is well known in the art.

The separation additive may have an HLB value of at least 10, preferably at least 11, more preferably at least 11.5. The separation additive may have an HLB value of at most 17, preferably at most 15, more preferably at most 14.8.

Preferably the separation additive is acceptable for animal consumption. This may be required because the stillage treated with the separation additive may be used in the production of distillers' dried grains (DDG) or distillers' dried grains with solubles (DDGS). DDG or DDGS may be used as an animal feedstock. Preferably the separation additive is acceptable for animal consumption. The separation additive may be generally recognized as safe (GRAS).

The requirement that the separation additive is acceptable for animal consumption may also influence the concentration of additive which may be added to the stillage. This is because there will typically be an upper concentration limit specified for the presence of the separation additive in the animal feedstock so that it is acceptable for animal consumption. This upper concentration limit may determine the maximum concentration of separation additive which may be added to the stillage. For GRAS, the maximum concentration of separation additive which may be added to the stillage may be 1000 ppm by weight of the stillage. If the maximum concentration of separation additive in the stillage is determined by the presence of the additive in the animal feedstock then an additive with a higher separation performance will be preferred to increase the oil yield.

The separation additive may be added to the stillage at a dosage of at most 4000 parts per million (ppm) of separation additive based on the weight of the stillage. The separation additive may be added at a dosage of at most 3000 ppm, preferably at most 2000 ppm, more preferably at most 1500 ppm, even more preferably at most 1000 ppm, or may be added at a dosage of at most 800 ppm. The separation additive may be added at a dosage of at least 50 ppm, preferably at least 100 ppm, more preferably at least 200 ppm, even more preferably at least 300 ppm.

The separation additive may be added at a dosage of at most 1000 ppm to satisfy the requirements to be GRAS. Preferably the separation additive is added at a dosage rate of at least 50 ppm and at most 1000 ppm based on the weight of the stillage.

In general, the process steps in ethanol production which include the distillation which separates ethanol from the whole stillage and the further downstream process steps are known as 'back-end' process steps. A typical process flow for the back-end process steps may include:

1. Distillation to separate ethanol from the whole stillage;
2. Centrifugation of the whole stillage to produce thin stillage and wet cake;
3. Evaporation of the thin stillage to produce steam and syrup (dewatered thin stillage); and
4. Drying of the syrup to produce DDGS.

The ethanol production process may be a Delta T or ICM corn to ethanol production process.

The method of the present invention may be used with a whole stillage, a thin stillage or a syrup. Preferably the separation additive is added to a whole stillage or a thin stillage. The stillage typically contains fibre, protein, lipids and yeast. The oil phase of the stillage may include triglycerides.

The separation operation may include one or more of a centrifugation operation, evaporation operation and drying operation.

Preferably, the separation operation includes centrifugation, and the separation additive is added to the stillage before or during centrifugation. Preferably, the separation additive is added to the stillage before the centrifugation occurs. The separation additive may be added after the majority of ethanol has been distilled away and before centrifugation.

Centrifugation may occur for at least one minute, preferably at least two minutes, preferably at least 3 minutes. Centrifugation may occur for up to 15 minutes, preferably up to 10 minutes, more preferably up to 6 minutes.

The time between the separation additive being added to the stillage and the oil phase being separated from the stillage may be at least thirty seconds, preferably at least one minute, more preferably at least two minutes, even more preferably at least 3 minutes. The time between the separation additive being added to the stillage and the oil phase being separated from the stillage may be up to 24 hours, preferably up to 12 hours, more preferably up to 4 hours, even more preferably up to 1 hour. The time between the separation additive being added to the stillage and the oil phase being separated from the stillage may be up to 45 minutes, preferably up to 30 minutes, more preferably up to 15 minutes, even more preferably up to 10 minutes.

The method may be performed above room temperature. The method may be performed at a temperature of at least 30° C., preferably at least 50° C., preferably at least 70° C. The method may be performed at a temperature of at most 95° C., preferably at most 90° C.

If the method is performed at a higher temperature, the oil phase and water phase of the stillage may separate more quickly. The separation additive may advantageously lower the temperature required to achieve a predetermined amount of separation by increasing the amount of the oil phase which is separated in a predetermined time without requiring a higher temperature. This may reduce the amount of heat energy (and therefore cost) required for the separation operation.

As shown in the examples below, the separation additive may perform better than an equivalent amount by weight of polysorbate 80. Better performance in this context should be understood to mean that more of the oil phase is separated by the separation additive from an equivalent amount of stillage under an equivalent separation operation than is separated by an equivalent amount by weight of polysorbate 80.

A predetermined amount of the separation additive may enable at least 10% more of the oil phase to be separated from a stillage than an equivalent amount by weight of polysorbate 80 under equivalent separation conditions. The increase in oil phase separation may be measured by volume. Preferably the separation additive may enable at least 15% more of the oil phase to be separated from the stillage than an equivalent amount by weight of polysorbate 80, preferably at least 20% more, more preferably at least 30% more. The separation additive may enable at most 100% more of the oil phase to be separated than an equivalent amount by weight of polysorbate 80, preferably at most 90% more.

The predetermined amount may be at most 1000 ppm of separation additive based on the weight of the stillage.

Viewed from a further aspect, the present invention provides the use of a separation additive to treat an aqueous liquid stillage including an aqueous phase and an oil phase to recover an amount of the oil phase from the stillage during a separation operation wherein the separation additive includes an ester of an alkoxylated non-cyclic polyol residue and a fatty acid, wherein the degree of esterification of the ester is at least two.

The separation additive which is the subject of the use may include any of the features of a separation additive herein described with reference to any aspect of the invention.

The use may include any of the method steps herein described with reference to any aspect of the invention.

Preferably, the separation additive is added at a dosage rate of at least 50 ppm and at most 1500 ppm based on the weight of the stillage.

Preferably, the separation additive enables at least 15% more of the oil phase to be separated from the stillage during the separation operation than if an equivalent amount by weight of polysorbate 80 had been used.

Viewed from a yet further aspect, the present invention provides a mixture of liquid stillage and a separation additive which includes an ester of an alkoxylated non-cyclic polyol residue and a fatty acid, wherein the degree of esterification of the ester is at least two.

The separation additive included in the mixture may include any of the features herein described with reference to any aspect of the invention.

All of the features described herein may be combined with any of the above aspects of the invention, in any combination.

EXAMPLES

The present invention will now be described further by way of example only with reference to the following Examples. All parts and percentages are given by weight unless otherwise stated.

It will be understood that all tests and physical properties listed have been determined at atmospheric pressure and room temperature (i.e. about 20° C.), unless otherwise stated herein, or unless otherwise stated in the referenced test methods and procedures.

The following test methods and procedures will be used for measurement of chemical characteristics unless otherwise stated:

Acid Value (Acid Number, AN)

The acid value was determined by using ASTM D1980-87 (Standard test method for acid value of fatty acids and polymerised fatty acids).

Hydroxyl Value (OH)

The hydroxyl value was measured by using ASTM D1957-86 (Standard test method for hydroxyl value of fatty oils and acids).

Saponification Value (SAP)

The saponification value was measured by using ASTM D5558 (Standard test method for vegetable and animal fats).

In these examples, the separation additives (SA) of the present invention and comparative examples (COM) listed in Table 1 below will be used:

TABLE 1

Separation Additives used in the Examples

| Short Name | Chemical Composition |
|---|---|
| COM1 | PEG-20 Sorbitan Mono-oleate (polysorbate 80) |
| COM2 | PEG-20 Sorbitan Tri-oleate |
| COM3 | PEG-20 Sorbitan Tetra-oleate |
| SA1 | PEG-50 Sorbitol Tetra-oleate synthesised according to Example 1 below |
| SA2 | Ethoxylated Sorbitol Oleate & PEG Oleate mixture |
| SA3 | PEG-50 Sorbitol Tetra-ester ex Soya Fatty Acid |
| SA4 | PEG-50 Sorbitol Tetra-ester ex Dehydrated Castor Oil Fatty Acid (DCOFA) |
| SA5 | PEG-50 Sorbitol Tetra-ester ex Corn Oil Fatty Acid (COFA) |

Example 1

Preparation of Separation Additive 1 (SA1)

A batch of SA1 was prepared as follows. The charge weights for the batch are listed in Table 2 below.

TABLE 2

Charge weights for preparation of SA1

| Material | Mole Ratio | Weight/grams | Wt % |
|---|---|---|---|
| PEG-50 Sorbitol | 1.00 | 478.7 | 31.9 |
| Oleic Acid | 4 | 1021.3 | 68.1 |
| Total | | 1500 | 100 |
| Catalyst: Tetra-n-Butyl Titanate (TBT) | | 0.1 | |
| Filter-aid: Harborlite 700 | | 2 | |

The following method was used to prepare the batch. To a clean and dry 2 litre reactor, charge the PEG-50 Sorbitol (ex Croda) and oleic acid at ambient conditions. With agitation and nitrogen sweep (or sparge) on, heat the reactor to 190° C. over 1 to 2 hours. Water vapor starts to come out from the reaction at 160° C. Keep the reaction at 185 to 200° C. for 3 to 4 hours. Sample for acid value (should be <15). Charge the catalyst (Tyzor TBT ex Du Pont), and keep the reaction for another 1 to 2 hours at 185 to 200° C. Sample for acid value (acid number, AN). If AN<2, proceed to cool the product. Test a sample for AN (<2), hydroxyl value (20 to 40), saponification value (70 to 90), Gardner colour (G<10), and water content (<0.5%). The product was a liquid with a theoretical HLB of 13.6 and will be referred to as Separation Additive 1 (SA1).

Example 2

Analysis of Performance of Separation Additives

For evaluation of corn oil separation efficiency, the separation additives and comparative examples are tested in the lab following the procedure described below.

Thin stillage samples obtained from corn ethanol plants were stored in a refrigerator to keep from being spoiled. Prior to the test, a stillage sample was taken out of the refrigerator and heated to 82° C. (180 F) in an oven. 40 mL of the pre-heated stillage sample was added to a 50-ml centrifuge tube, and 400 ppm of separation additive was added into the sample. The sample was centrifuged at 7000 rpm for 3 minutes. The corn oil yield was measured by measuring the height of the clear oil layer with a spencer.

Tables 3 to 5 below illustrate that corn oil yields vary significantly, depending on the chemistries of the additives applied. For each separation additive, 5 samples from two stillages (Stillage A and Stillage B) were treated and the height of the clear oil layer (indicating the separation performance) was measured for each sample. The average height (performance) and standard deviation (STD) were also calculated. Stillage A and Stillage B are representative stillages from different types of corn at different ages of harvest.

TABLE 3

The corn oil yield of two stillage samples using COM1 as separation additive.

| | Sample Number | | | | | | |
|---|---|---|---|---|---|---|---|
| | #1 | #2 | #3 | #4 | #5 | Average | STD |
| Stillage A | 8 | 8 | 8 | 9 | 9 | 8.4 | 0.55 |
| Stillage B | 9 | 8 | 8 | 9 | 8 | 8.4 | 0.55 |

TABLE 4

The corn oil yield of two stillage samples using SA1 as separation additive.

| | Sample Number | | | | | | |
|---|---|---|---|---|---|---|---|
| | #1 | #2 | #3 | #4 | #5 | Average | STD |
| Stillage A | 15 | 16 | 16 | 16 | 16 | 15.8 | 0.45 |
| Stillage B | 12 | 12 | 11 | 12 | 12 | 11.8 | 0.45 |

TABLE 5

The corn oil yield of two stillage samples using SA2 as separation additive.

| | Sample Number | | | | | | |
|---|---|---|---|---|---|---|---|
| | #1 | #2 | #3 | #4 | #5 | Average | STD |
| Stillage A | 14 | 14 | 14 | 14 | 15 | 14.2 | 0.45 |
| Stillage B | 14 | 12 | 13 | 14 | 13 | 13.2 | 0.84 |

Example 3

Comparison of Performance of Separation Additives with Comparative Examples

Table 6 below compares the performance of various separation additives against that of COM1 (polysorbate 80). Each separation additive is tested on 5 samples of Stillage A and B as set out in Example 2 above. An average height of corn oil in the separated samples is calculated for each separation additive for Stillage A and B. For ease of comparison, the average height of corn oil in the samples using COM1 (taken from Table 3) is given a representative score of 100% (i.e. a performance of 100% vs COM1). The performance of the separation additives on Stillages A and B are scaled against that of COM1, based on the measurements taken. For example, the average height of corn oil separated by COM1 for Stillage A is 8.4 (see Table 3). The average height of corn oil separated by SA1 for Stillage A is 15.8 (see Table 4). Therefore the performance score for SA1 for Stillage A is (15.8/8.4)*100=188%.

In summary, a performance score higher than 100% indicates that a separation additive performed better than COM1 (a higher level of separated corn oil in the sample) while a performance score lower than 100% indicates a poorer performance than COM1.

TABLE 6

Comparison of Corn Oil Separation Performance

| Additive | Average Degree of | Theoretical | Average Separation Performance Score relative to COM1 in % (COM1 = 100%) | |
|---|---|---|---|---|
| Name | Esterification | HLB | Stillage A | Stillage B |
| COM1 | 1 | 15 | 100 | 100 |
| COM2 | 3 | 11.4 | 76 | 70 |
| COM3 | 4 | 10.2 | 45 | 48 |
| SA1 | 4 | 13.6 | 188 | 140 |
| SA2 | 4 | 11.7 | 169 | 157 |
| SA3 | 4 | 13.6 | 138 | 143 |
| SA4 | 4 | 13.6 | / | 133 |
| SA5 | 4 | 14.8 | 136 | 131 |

From analysis of the results in Table 6, it can be seen that the multiply esterified sorbitans COM2 (PEG-20 Sorbitan Tri-oleate) and COM3 (PEG-20 Sorbitan Tetra-oleate) do not perform as well as the sorbitan mono-ester COM1 (PEG-20 Sorbitan Mono-oleate or polysorbate 80). This appears to indicate that when sorbitan is used as the core group, increasing the degree of esterification reduces the performance of the separation additive.

In contrast, when sorbitol is used as the core group, increasing the degree of esterification appears to improve the performance of the separation additive. This improved performance is shown by SA1, SA2, SA3, SA4 and SA5.

The performance of SA1, SA2, SA3, SA4 and SA5 is improved by at least 30% with regard to COM1. This improvement can provide a significant increase in the yield of corn oil obtained when these separation additives are used in the method of the present invention.

It is to be understood that the invention is not to be limited to the details of the above embodiments, which are described by way of example only. Many variations are possible.

The invention claimed is:

1. A method of separating corn oil from a stillage, the stillage including an aqueous phase and an oil phase, wherein the method comprises adding a separation additive to the stillage and performing at least one separation operation on the stillage to separate an amount of the oil phase from the stillage, wherein the separation additive comprises an ester of an alkoxylated non-cyclic polyol and a fatty acid and wherein the degree of esterification of the ester is at least two.

2. A method as claimed in claim 1 wherein the non-cyclic polyol is selected from the group consisting of glycerol, neopentyl glycol, trimethylol propane, pentaerythritol, a sugar alcohol and mixtures thereof, wherein the separation additive is added at a dosage rate of at least 50 ppm and at most 4000 ppm based on the weight of the stillage.

3. A method as claimed in claim 1 wherein the non-cyclic polyol is a non-cyclic sugar alcohol, and wherein the separation additive is added at a dosage rate of at least 50 ppm and at most 4000 ppm based on the weight of the stillage.

4. A method as claimed in claim 1 wherein the degree of esterification of the ester of an alkoxylated non-cyclic polyol and a fatty acid is in the range from 2.5 to 5.5.

5. A method as claimed in claim 1 wherein the alkoxylated non-cyclic polyol has been alkoxylated with at least 25 mols of an alkylene oxide.

6. A method as claimed in claim 5 wherein the alkylene oxide comprises at least 80 mol % ethylene oxide.

7. A method as claimed in claim 1 wherein the fatty acid is a mono-carboxylic acid and the fatty acid has from 6 to 24 carbon atoms.

8. A method as claimed in claim 1 wherein the separation additive is suitable for use in an animal feedstock.

9. A method as claimed in claim 1 wherein the non-cyclic polyol is selected from glycerol, sorbitol or mixtures thereof, and wherein the separation additive is added at a dosage rate of at least 50 ppm and at most 4000 ppm based on the weight of the stillage.

10. A method as claimed in claim 1 wherein the separation additive comprises an ester of an ethoxylated sorbitol and a fatty acid having from 6 to 24 carbon atoms, wherein the sorbitol has been ethoxylated with from 45 to 55 mols of ethylene oxide and the degree of esterification is from 3.5 to 4.5, and wherein the separation additive is added at a dosage rate of at least 50 ppm and at most 4000 ppm based on the weight of the stillage.

11. A method as claimed in claim 1 wherein the separation additive further comprises less than 30 wt % of an ester of a polyalkylene glycol and a fatty acid.

12. A method as claimed in claim 1 wherein the separation operation includes centrifugation and the separation additive is added to the stillage before or during centrifugation.

13. A method as claimed in claim 1 wherein the separation additive is added at a dosage rate of at least 50 ppm and at most 1000 ppm based on the weight of the stillage.

14. A method as claimed in claim 1 wherein the separation additive enables at least 15% more of the oil phase to be separated from the stillage during the separation operation than if an equivalent amount by weight of polysorbate 80 had been used.

15. A method of treating a stillage including an aqueous phase and an oil phase to recover an amount of the oil phase from the stillage during a separation operation comprising adding a separation additive to the stillage, wherein the separation additive includes an ester of an alkoxylated non-cyclic polyol and a fatty acid, wherein the degree of esterification of the ester is at least two.

16. A method as claimed in claim 15 wherein the non-cyclic polyol is selected from the group consisting of glycerol, neopentyl glycol, trimethylol propane, pentaerythritol, a sugar alcohol and mixtures thereof, wherein the separation additive is added at a dosage rate of at least 50 ppm and at most 4000 ppm based on the weight of the stillage.

17. A method as claimed in claim 15 wherein the separation additive is added at a dosage rate of at least 50 ppm and at most 1000 ppm based on the weight of the stillage.

18. A method as claimed in claim 15 wherein the separation additive enables at least 15% more of the oil phase to be separated from the stillage during the separation operation than if an equivalent amount by weight of polysorbate 80 had been used.

19. A mixture of stillage and a separation additive which includes an ester of an alkoxylated non-cyclic polyol and a fatty acid, wherein the degree of esterification of the ester is at least two.

20. A mixture as claimed in claim 19 wherein the non-cyclic polyol is selected from the group consisting of glycerol, neopentyl glycol, trimethylol propane, pentaerythritol, a sugar alcohol and mixtures thereof, and wherein the separation additive is present in an amount of at least 50 ppm and at most 4000 ppm based on the weight of the stillage.

* * * * *